US006695941B2

(12) United States Patent
Hartgrove et al.

(10) Patent No.: US 6,695,941 B2
(45) Date of Patent: Feb. 24, 2004

(54) METHOD OF MAKING NONWOVEN FABRIC FOR BUFFING APPLICATIONS

(75) Inventors: Herbert P. Hartgrove, Angier, NC (US); Robert Gregory Rabon, Clayton, NC (US); Edwin Gregory Browne, Charlotte, NC (US); Cheryl L. Carlson, Willow Springs, NC (US); Nick Mark Carter, Mooresville, NC (US)

(73) Assignee: Polymer Group, Inc., North Charleston, SC (US)

( * ) Notice: Subject to any disclaimer, the term of this patent is extended or adjusted under 35 U.S.C. 154(b) by 300 days.

(21) Appl. No.: 09/871,433

(22) Filed: May 31, 2001

(65) Prior Publication Data

US 2002/0023326 A1 Feb. 28, 2002

Related U.S. Application Data

(60) Provisional application No. 60/209,398, filed on Jun. 1, 2000.

(51) Int. Cl.[7] ..... D04H 5/08

(52) U.S. Cl. ..... 156/148; 28/104; 28/105

(58) Field of Search ..... 156/148; 28/104–105

(56) References Cited

U.S. PATENT DOCUMENTS

| | | | | |
|---|---|---|---|---|
| 3,485,706 A | | 12/1969 | Evans | |
| 4,931,355 A | * | 6/1990 | Radwanski et al. | 442/344 |
| 5,098,764 A | | 3/1992 | Drelich et al. | |
| 5,989,113 A | | 11/1999 | Arnold | |

* cited by examiner

*Primary Examiner*—Sam Chuan Yao
(74) *Attorney, Agent, or Firm*—Wood, Phillips, Katz, Clark & Mortimer

(57) ABSTRACT

A method of forming a nonwoven fabric suitable for metal-finishing buffing operations includes providing a precursor web comprising polyester, staple length fibers, with hydroentanglement of the web effected to impart desired physical characteristics. Hydroentanglement is effected on a three-dimensional, image transfer device having an array of three-dimensional surface elements for patterning the fabric which is formed. Application of a binder composition lends desired durability to the fabric, with the binder composition preferably including a melamine polymeric composition to achieve the desired strength and abrasion resistance.

8 Claims, 3 Drawing Sheets

FIG. 3
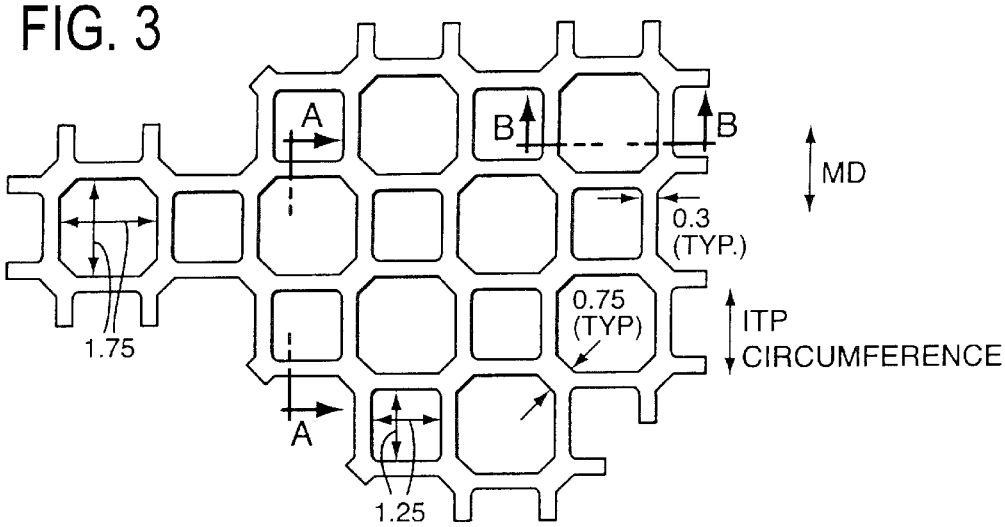
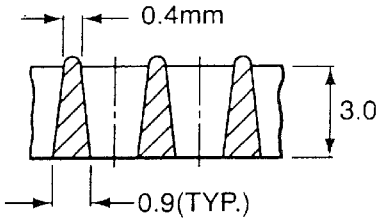
SECT. A - A
FIG. 4
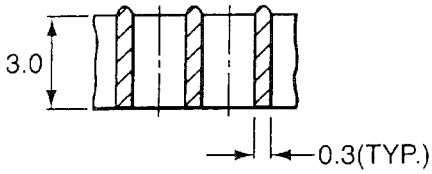
SECT. B - B
FIG. 5
FIG. 2
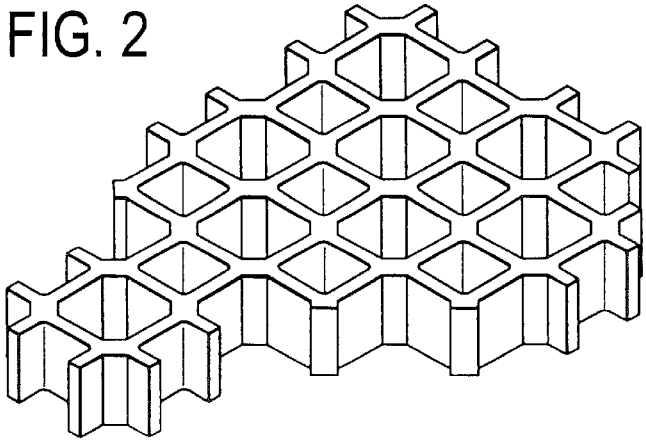

SECTION A-A

METHOD OF MAKING NONWOVEN FABRIC FOR BUFFING APPLICATIONS

TECHNICAL FIELD

The present invention relates generally to a method of making a nonwoven fabric through hydroentanglement of a staple fiber precursor web, and more particularly to a method of making a nonwoven fabric through hydroentanglement and by treatment with a binder composition which facilitates use of the fabric for buffing applications for finishing metals, marble, plastics, and other materials.

BACKGROUND OF THE INVENTION

The production of conventional textile fabrics is known to be a complex, multi-step process. The production of fabrics from staple fibers begins with the carding process where the fibers are opened and aligned into a feed stock known as sliver. Several strands of sliver are then drawn multiple times on drawing frames to further align the fibers, blend, improve uniformity as well as reduce the diameter of the sliver. The drawn sliver is then fed into a roving frame to produce roving by further reducing its diameter as well as imparting a slight false twist. The roving is then fed into the spinning frame where it is spun into yarn. The yarns are next placed onto a winder where they are transferred into larger packages. The yarn is then ready to be used to create a fabric.

For a woven fabric, the yarns are designated for specific use as warp or fill yarns. The fill yarn packages (which run in the cross direction and are known as picks) are taken straight to the loom for weaving. The warp yarns (which run on in the machine direction and are known as ends) must be further processed. The packages of warp yarns are used to build a warp beam. Here the packages are placed onto a warper which feeds multiple yarn ends onto the beam in a parallel array. The warp beam yarns are then run through a slasher where a water soluble sizing is applied to the yarns to stiffen them and improve abrasion resistance during the remainder of the weaving or knitting process. The yarns are wound onto a loom beam as they exit the slasher, which is then mounted onto the back of the loom. Here the warp and fill yarns are interwoven or knitted in a complex process to produce yardages of cloth. Once the fabric has been manufactured, a scouring process is necessary to remove the size from the warp yarns before it can be dyed or finished. Currently, commercial high speed looms operate at a speed of 1000 to 1500 picks per minute, where a pick is the insertion of the filling yarn across the entire width of the fabric. Commercial woven fabrics used in the intended application of the instant invention range from 40×40 to 80×80 picks per inch. Therefore, these fabrics would be produced at commercial speeds of about 25 to 40 inches of fabric per minute.

In contrast, the production of nonwoven fabrics from staple fibers is known to be more efficient than traditional textile processes as the fabrics are produced directly from the carding process. Nonwoven fabrics are suitable for use in a wide variety of applications where the efficiency with which the fabrics can be manufactured provides a significant economic advantage for these fabrics versus traditional textiles. However, nonwoven fabrics have commonly been disadvantaged when fabric properties are compared, particularly in terms of surface abrasion, pilling and durability in multiple-use applications. Hydroentangled fabrics have been developed with improved properties which are a result of the entanglement of the fibers or filaments in the fabric providing improved fabric integrity. Subsequent to entanglement, fabric durability can be further enhanced by the application of binder compositions and/or by thermal stabilization of the entangled fibrous matrix.

U.S. Pat. No. 3,485,706, to Evans, hereby incorporated by reference, discloses processes for effecting hydroentanglement of nonwoven fabrics. More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, hereby incorporated by reference, with the use of such image transfer devices being desirable for providing a fabric with enhanced physical properties as well as an aesthetically pleasing appearance.

For specific applications, a nonwoven fabric must exhibit a combination of specific physical characteristics. Many material finishing operations require the use of power-driven buffing wheels or belts for buffing and polishing metal, rubber, marble, and plastic surfaces. Buffing wheels typically comprise a hub component to which one or more woven textile elements are secured for contact with the surface to be treated. Woven cotton and polyester/cotton materials have typically been employed since such materials can exhibit the necessary non-abrasiveness, absorbency, heat resistance, low elongation, and dimensional stability. By virtue of the absorbency of such materials, the typical water-based buffing and polishing compounds are absorbed and retained by the fabric, with abrasive grit in the compounds sized to achieve the desired buffing or polishing effect.

Certain disadvantages are associated with the typical use of woven fabrics for buffing applications. In order to employ woven fabrics in buffing applications it is necessary to orient the fabric at a 45° angle to minimize fraying during use. This application of "bias slitting" requires additional processing by specialized equipment, further complicating buffing wheel manufacture. Furthermore, woven fabrics tend to exhibit poor localized dimensional stability as the strength imparted by the woven structure degrades as a consequence of the repetitive impact and resultant fracturing of the supporting yarns during the stresses imposed by buffing. Additionally, price fluctuations in textile commodities can detract from economical use of such woven fabrics.

Heretofore, attempts to employ nonwoven fabrics for buffing applications have met with limited commercial success. U.S. Pat. No. 5,989,113, hereby incorporated by reference, discloses a buffing tool comprising a spunlaced (hydroentangled) nonwoven fabric. The material contemplated by the referenced patent does not exhibit the desired levels of durability, absorbency or improved buffing properties that can be obtained by the imaged nonwoven fabric of the present invention.

The present invention is directed to a method of making a nonwoven fabric for buffing applications, which fabric exhibits excellent durability as well as absorbency to facilitate economical and efficient use.

SUMMARY OF THE INVENTION

A method of making a nonwoven fabric embodying the principles of the present invention contemplates use of staple length polyester fibers to facilitate economical fabric formation. Formation of the fabric on a three-dimensional, image transfer device by hydroentangling imparts desired physical properties to the fabric to facilitate its use in buffing applications. Additionally, treatment of the fabric with a binder composition provides the necessary durability for the fabric for buffing surfaces, including metal, rubber, marble, and plastic.

A method of making a nonwoven fabric in accordance with the present invention includes providing a precursor web comprising polyester staple length fibers. The precursor web is preferably pre-entangled on a foraminous forming surface, preferably through the use of high-pressure water jets.

The present method further entails the provision of a three-dimensional, image transfer device having an array of three-dimensional surface elements thereon. The precursor web is positioned on the image transfer device, and hydroentangled to form an imaged nonwoven fabric having a pattern of apertures therein.

The present invention further contemplates application of a polymeric binder composition to the imaged fabric. Notably, the binder composition comprises a melamine polymeric compound in the range of 0.2% to 0.5% weight to volume, and an acrylic/copolymer compound is the range of 10 to 25% weight to volume, which desirably acts to impart the necessary durability to the imaged fabric. In accordance with the present invention, the resultant fabric has a Combined Tensile Strength of at least about 800 grams per ounce of fabric, and further, has a Taber Abrasion of at least 1000 cycles.

In accordance with one illustrated embodiment, the three-dimensional image transfer device has an array of three-dimensional surface elements having an octagon-and-square configuration. An alternative image transfer device has an array of three-dimensional surface elements having a herringbone configuration. These presently preferred image transfer devices act, through hydroentanglement, to impart a high degree of strength and durability to the nonwoven fabric. Additionally, the forming surface can be configured to form apertures in the nonwoven fabric which desirably act to facilitate thermal dispersion during use of the fabric for buffing applications. It is contemplated that the fabric can be selectively apertured, whereby apertures can be provided at the inner portion of a rotary buffing tool to provide thermal dispersion, while avoiding occlusion of apertures at a peripheral portion of the tool.

In the preferred form, the binder composition not only includes a melamine polymeric compound, but further preferably includes an acrylic/copolymer composition. The polymers of the binder composition cooperate to provide the desired durability for buffing applications. Additionally, this binder composition desirably acts to abate deposition of any polyester residue, which can result from degradation of the polyester fibers from heat generated during buffing.

Other features and advantages of the present invention will become readily apparent from the following detailed description, the accompanying drawings, and the appended claims.

BRIEF DESCRIPTION OF THE DRAWINGS

FIG. 2 is a fragmentary, isometric view of the forming surface of a three-dimensional image transfer device, having an octagon-and-square configuration, of the type used for practicing the present invention;

FIG. 3 is a fragmentary plan view of the forming surface shown in FIG. 2;

FIG. 4 is a sectional view taken along lines A—A of FIG. 3;

FIG. 5 is a sectional view taken along lines B—B of FIG. 3;

DETAILED DESCRIPTION

Figure 1:
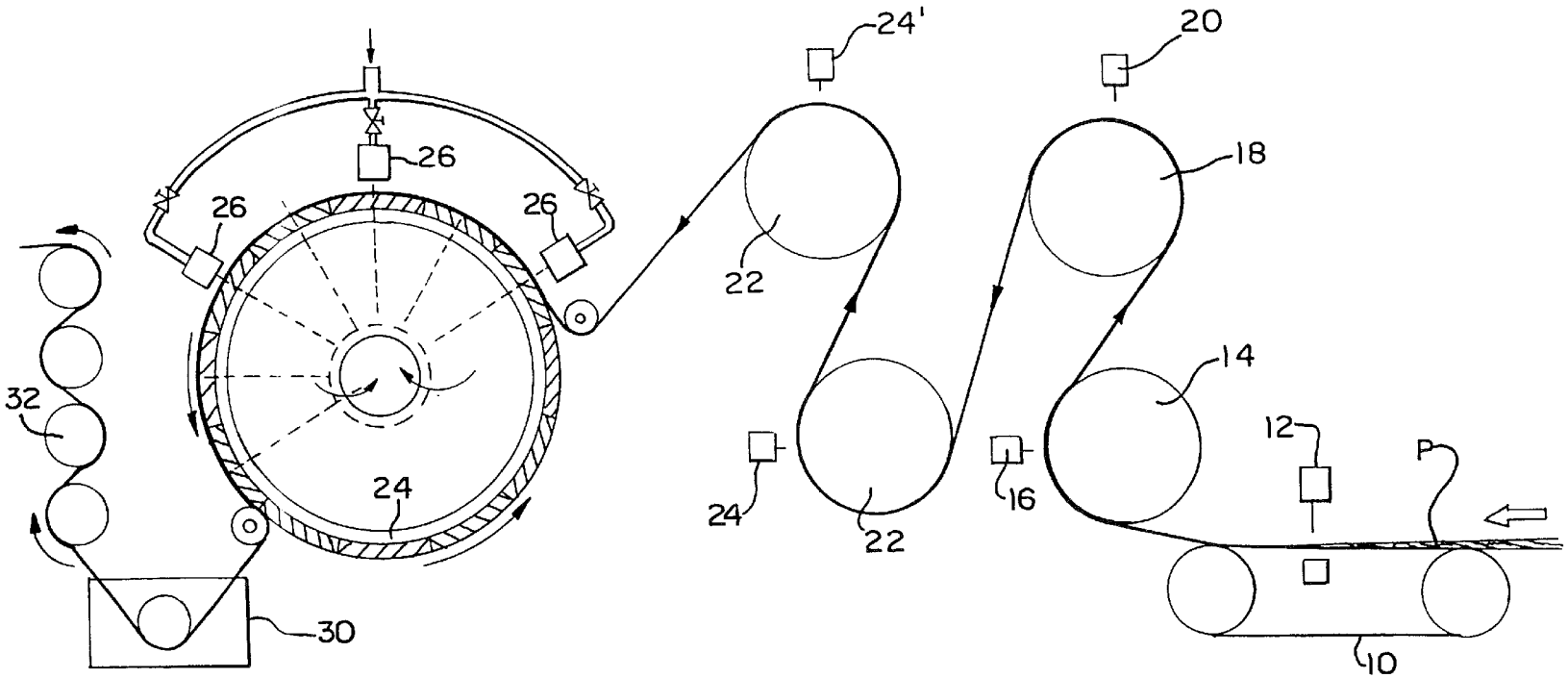
FIG. 1 is a diagrammatic view of an apparatus for manufacturing a nonwoven fabric embodying the principles of the present invention.

While the present invention is susceptible of embodiment in various forms, there is shown in the drawings, and will hereinafter be described, a presently preferred embodiment of the invention, with the understanding that the present disclosure is to be considered as an exemplification of the invention, and is not intended to limit the invention to the specific embodiment illustrated.

The present invention is directed to a method of forming nonwoven fabrics by hydroentanglement, wherein imaging and patterning of the fabrics is enhanced by hydroentanglement on a three-dimensional image transfer device. By use of an image transfer device configured in accordance with the present invention, together with application of a binder composition particularly formulated for enhancing fabric durability, fabrics formed in accordance with the present invention are particularly suited for material-finishing buffing applications, including finishing of metal, rubber, marble, and plastic surfaces. The fabrics exhibit the desired level of absorbency for "wet out" of water-based buffing and polishing compounds, with the preferred formation from staple length polyester fibers facilitating economical manufacture and use.

With reference to FIG. 1, therein is illustrated an apparatus for practicing the present method for forming a nonwoven fabric. The fabric is formed from a fibrous matrix preferably comprising polyester staple length fibers, but it is within the purview of the present invention that different types of fibers, or fiber blends, can be employed. The fibrous matrix is preferably carded and cross-lapped to form a precursor web, designated P. In a current embodiment, the precursor web comprises 100% staple length polyester fibers.

FIG. 1 illustrates a hydroentangling apparatus for forming nonwoven fabrics in accordance with the present invention. The apparatus includes a foraminous forming surface in the form of belt 10 upon which the precursor web P is positioned for pre-entangling by entangling manifold 12. Pre-entangling of the precursor web, prior to imaging and patterning, is subsequently effected by movement of the web P sequentially over a drum 14 having a foraminous forming surface, with entangling manifold 16 effecting entanglement of the web. Further entanglement of the web is effected on the foraminous forming surface of a drum 18 by entanglement manifold 20, with the web subsequently passed over successive foraminous drums 20, for successive entangling treatment by entangling manifolds 24, 24'.

The entangling apparatus of FIG. 1 further includes an imaging and patterning drum 24 comprising a three-dimensional image transfer device for effecting imaging and patterning of the now-entangled precursor web. The image transfer device includes a moveable imaging surface which moves relative to a plurality of entangling manifolds 26 which act in cooperation with three-dimensional elements defined by the imaging surface of the image transfer device to effect imaging and patterning of the fabric being formed.

The present invention contemplates that the precursor web P be advanced onto the moveable imaging surface of the image transfer device at a rate which is substantially equal to the rate of movement of the imaging surface. As illustrated in FIG. 1, a J-box or scray 23 can be employed for supporting the precursor web P as it is advanced onto the image transfer device to thereby minimize tension within the precursor web. By controlling the rate of advancement of the precursor web onto the imaging surface to minimize, or substantially eliminate, tension within the web, enhanced hydroentanglement of the precursor web is desirably effected. Hydroentanglement results in portions of the precursor web being displaced from on top of the three-dimensional surface elements of the imaging surface to form an imaged and patterned nonwoven fabric. Enhanced Z-direction entanglement is desirably achieved, thus providing improved imaging and patterning, and enhanced physical properties for the resultant fabric.

The accompanying Table 1 sets forth comparative test data for various known fabrics and fabrics formed in accordance with the present invention. Manufacture of a durable nonwoven fabric embodying the principles of the present invention is initiated by providing the precursor nonwoven web preferably in the form of a fibrous matrix comprising 100% polyester, staple length fibers, the use of which promotes economical practice of the present invention. In the examples which follow, DuPont 54W polyester fiber was employed, but Wellman T472 polyester fiber could alternatively be used.

EXAMPLE 1

Using a forming apparatus as illustrated in FIG. 1, a nonwoven fabric was made in accordance with the present invention (designated Example 1 in Table 1) by providing a precursor web comprising polyester fibers. The web had a basis weight of 3.5 ounces per square yard (plus or minus 7%). The precursor web was 100% carded and cross-lapped, with a draft ratio of 2.5 to 1.

The fabric comprised DuPont 54W polyester (1.2 denier, 1.5 inch staple length). Prior to patterning and imaging of the precursor web, the web was entangled by a series of entangling manifolds such as diagrammatically illustrated in FIG. 1. FIG. 1 illustrates disposition of precursor web P on a foraminous forming surface in the form of belt 10, with the web acted upon by an entangling manifold 12. The web then passes sequentially over a drum 14 having a foraminous forming surface, for entangling by entangling manifold 16, with the web thereafter directed about the foraminous forming surface of a drum 18 for entangling by entanglement manifold 20. The web is thereafter passed over successive foraminous drums 22, with successive entangling treatment by entangling manifolds 24, 24'. In the present examples, each of the entangling manifolds included 120 micron orifices spaced at 42.3 per inch, with the manifolds successively operated at 70, 90, 120, 120, and 120 bar, with a line speed of 50 yards per minute. A web having a width of 75 inches was employed.

The entangling apparatus of FIG. 1 further includes an imaging and patterning drum 25 comprising a three-dimensional image transfer device for effecting imaging and patterning of the now-entangled precursor web. The entangling apparatus includes a plurality of entangling manifolds 26 which act in cooperation with the three-dimensional image transfer device of drum 25 to effect patterning of the fabric. In the present example, the entangling manifolds 26 were successively operated at 130, 165, and 165 bar, at a line speed which was the same as that used during pre-entanglement.

The three-dimensional image transfer device of drum 25 was configured as a so-called octagon and square, as illustrated in FIGS. 2, 3, 4, and 5.

Subsequent to patterned hydroentanglement, the fabric receives a substantially uniform application of polymeric binder composition at application station 30. The web is then directed through a tenter apparatus 32, operated at temperatures as specified, with manufacture of the nonwoven fabric of the present invention thus completed.

In the present example, the polymeric binder composition was applied at a line speed of 25 yards per minute, with a nip pressure of 50 psi, mixed solids were believed to be approximately 14%, and percent wet pick up of approximately 150–160%. The composition was applied via dip and nip saturation on a tenter frame No. 4. Tenter oven temperature was set at 450° F.

The polymeric binder composition formulation, by weight percent of bath, was as follows:

Water 83.14%
DeFoam 525 0.1%
(DeFoam is a surface tension reducer)
Wet Aid Special 0.5%
(Wet Aid is a surface tension reducer)
Rhoplex.RTM TR470 15.0%
(Rhoplex is an acrylic/copolymer emulsion)
Registered to Rhom & Haas Co. of Delaware
Cymel.RTM 303 Resin 0.24%
(Cymel is a melamine cross-linking resin)
Registered to American Cyanamid Co. of New York
Freecat.RTM 187 0.02%
(Freecat is a chemical catalyst)
Registered to Freedom Textile Chemicals Co. of North Carolina
MilSoft.RTM N23 1.0%
(MilSoft is an anti-static coating)
Registered to Atlas Chemical Industries of Delaware

EXAMPLE 2

Figure 6:
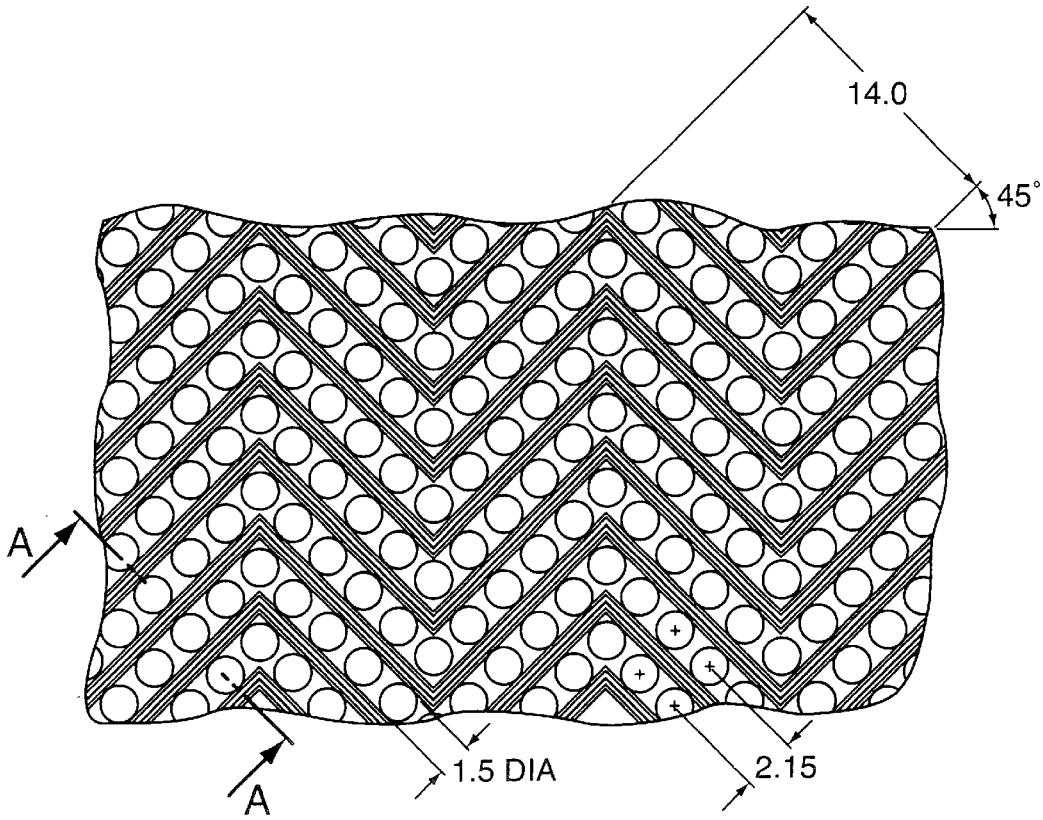
FIG. 6 is a fragmentary plan view of the forming surface of a three-dimensional image transfer device, having a herringbone configuration, of the type used for practicing the present invention.
Figure 7:
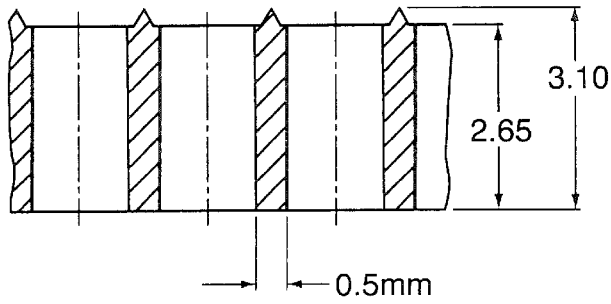
FIG. 7 is a sectional view taken along lines A—A of FIG. 6.

Using the process set forth above in connection with Example 1, another fabric was formed, designated Example 2 in Table 1. The process conditions were different in that the image transfer device of drum 25 was configured as a so-called herringbone pattern, as illustrated in FIGS. 6 and 7. For binder application, the line speed was 20 yards per minute, with a nip pressure of 32 psi, and a wet-pick-up of 130%. In the binder composition, Rhoplex K3 was substituted for the Rhoplex TR407, at the same percentage; the binder composition had 7.72% mixed solids. Tenter oven temperature was set at 300° F.

For practice of the present invention, the specific binder composition formulation can be varied. For example, the acrylic binder may comprise approximately 10–25% of the formulation, the pigments 1–3%, the melamine cross-linker 0.2–0.5%, and the various wetting agents and antimigrants less than 1%.

The data tabulated in Table 1 shows the highly desirable durability characteristics obtained through practice of the present invention, including nonwoven fabrics having a high Combined Tensile Strength (machine direction tensile+cross-direction tensile÷per fabric basis weight, and high Taber Abrasion. Comparison with a fabric formed in accordance with U.S. Pat. No. 5,989,113 shows significantly improved physical properties.

A further benefit of nonwoven fabrics formed in accordance with the present invention for buffing application is derived from the surface irregularities which can be formed in the fabric attendant to fabric imaging and patterning on three-dimensional image transfer devices.

The performance of surface irregularities as a means for retaining compounds or agents applied temporarily thereto was examined by the simple application of buffing compound by a doctor blade. Specifically, one inch×seven inch strips were cut from a greige fabrics having the same 100% PET fiber composition as described above. The first fabric was imaged by the use of an Image Transfer Device 25 having an "herringbone" pattern imparted thereto (equivalent to the greige fabric of Example 2). The second fabric was imparted with a pattern in accordance with "octagon and square" (equivalent to the greige fabric of Example 1). A final fabric was not imparted with a pattern, and represents the nonwoven fabric of conventional practice. The three fabric samples were initially weighed and the results recorded.

The three fabric samples were placed in side-by-side juxtaposition with their respective long dimensions adjoining. A beveled edge, six inch polymeric broad knife was then loaded on the beveled side within an excess of thoroughly homogenized, commercially available polishing compound as available from TurtleWax Inc., of Chicago. The loaded broad knife was then placed bevel side down on the positioned fabric samples, approximately one inch from the terminal end of the samples, with an overhang of 1.5 inches off of each side of the sample collection. The broad knife was then brought on the loaded beveled side to an incident angle of approximately 45 degrees, a force of about 0.5 pounds per linear inch was then applied to the knife as it was drawn at a constant rate of about 1 inch per second and until such time the broad knife moved completely beyond the termination of the fabric samples. The three loaded fabric samples where then removed and re-weighed. The results of this evaluation are provided in Table 2.

As can be seen in the results of Table 2, such surface irregularities desirably act to retain buffing and polishing compounds during use, thus benefitting and enhancing efficiency. The lack of patterning in prior art nonwoven fabrics, such as disclosed in the above-referenced patent, does not facilitate retention of buffing compounds in this fashion. Furthermore, the depth of the image may be varied such that the quantity of buffing compound retained may be adjusted. While formation of apertures in an imaged pattern fabric formed in accordance with the present invention is contemplated to facilitate thermal dispersion during buffing operations, it is within the purview of the present invention that fabrics be selectively apertured, through appropriate configuration of the image transfer device employed during formation, so that apertures can be provided a portions of a buffing wheel spaced from its periphery, thus avoiding occlusion of apertures with buffing compounds.

From the foregoing, numerous modifications and variations can be effected without departing from the true spirit and scope of the novel concept of the present invention. It is to be understood that no limitation with respect to the specific embodiments disclosed herein are intended or should be inferred. The disclosure is intended to cover, by the appended claims, all such modifications as fall within the scope of the claims.

TABLE 1

| Name | Test Method | Comparative Textile | Example 1 | Example 2 | Prior Art 5,989,113 |
|---|---|---|---|---|---|
| Composition | | 100% Cotton | 100% PET | 100% PET | |
| Image | | no image | Oct/Sq | herringbone | |
| Basis Weight (oz/y$^2$) | | 4.48 | 3.5 | 3.8 | 1.48 to 14.8 |
| Bulk (mils) | | 28.5 | 21.5 | 36 | 12 to 197 |
| Grab Tensile (N/50 mm, EN 29 073) | EN 29 073 | | | | |
| MD | | not performed | 1539 | 1947 | 150 to 500 |
| CD | | not performed | 1312 | 1625 | 150 to 500 |
| Elongation %, EN 27 073) | EN 29 073 | | | | |
| MD | | not performed | 38.8 | 76.0 | 50 to 150 |
| CD | | not performed | 65.4 | 108.7 | 50 to 150 |
| Grab Tensile (lbs.) | TM 7012 | | | | |
| MD | | 31.15 | 95.4 | 98.5 | |
| CD | | 31.05 | 4.2 | 90.0 | |
| Elongation (%, 4 × 6) | | | | | |
| MD | | 50.1 | 37.0 | 72.2 | |
| CD | | 50.1 | 67.0 | 94.6 | |
| Elmendorf Tear (grams) | | | | | |
| MD | | 1516 | 1393 | 2191 | |
| CD | | >1600 | 1213 | 2620 | |
| Absorbent Capacity (grams) | | 543.5 | 497 | 649 | |
| Mullen Burst (psi) | | 68 | 134 | 135 | |

TABLE 1-continued

| Name | Test Method | Comparative Textile | Example 1 | Example 2 | Prior Art 5,989,113 |
|---|---|---|---|---|---|
| Air Permeability (cfm/in) | | not performed | 199 | >278 | |
| Taber Abrasion (cycles) | | 157 | >1100 | >4000 | |
| Absorbency per oz/y$^2$ | | 121.3 | 142.0 | 170.8 | |
| Fabric Weight | | | | | |
| Combined Tensile per Ounce Fabric Weight | | | 814 | 940 | 20 to 676 |

TABLE 2

| | Bulk | Weight Before Loading | Weight After Loading |
|---|---|---|---|
| Herringbone | 0.048 | 0.56 | 3.2 |
| Octagon and Square | 0.034 | 0.56 | 2.2 |
| No Image | 0.022 | 0.57 | 1.1 |

What is claimed is:

1. A method of making a nonwoven fabric for powered buffing applications, comprising the steps of:

providing a precursor web comprising polyester staple length fibers;

providing a foraminous, three-dimensional image transfer device having an array of three-dimensional surface elements;

positioning said precursor web on said image transfer device, and hydroentangling said precursor web to form an imaged nonwoven fabric having surface irregularities configured to enhance retention of an associated buffing compound, and applying a polymeric binder composition to said imaged nonwoven fabric to provide said fabric with a Combined Tensile Strength of at least about 800 grams/ounce of fabric, said polymeric binder composition comprising a melamine polymeric compound. and an acrylic/copolymer composition, said imaged nonwoven fabric has a Taber Abrasion of at least about 1000 cycles after application of said binder composition.

2. A method of making a nonwoven fabric in accordance with claim 1, including:

pre-entangling said precursor web on a foraminous forming surface prior to said step of hydroentangling said precursor web on said image transfer device.

3. A method of making a nonwoven fabric in accordance with claim 1, wherein:

said step of hydroentangling said precursor web on said image transfer device includes forming a pattern of surface irregularities in the nonwoven fabric formed thereby.

4. A method of making a nonwoven fabric in accordance with claim 3, wherein:

said pattern of surface irregularities include apertures.

5. A method of making a nonwoven fabric in accordance with claim 3, wherein:

said pattern of surface irregularities include raised portions.

6. A method of making a nonwoven fabric for powered buffing applications, comprising the steps of:

providing a precursor web comprising polyester staple length fibers;

pre-entangling said precursor web on a foraminous forming surface;

providing a three-dimensional image transfer device having an array of three-dimensional surface elements;

positioning said precursor web on said image transfer device, and hydroentangling said precursor web to form an imaged nonwoven fabric having surface irregularities configured to enhance retention of an associated buffing compound and a pattern of apertures therein; and applying a polymeric binder composition to said imaged fabric, said binder composition comprising a melamine polymeric compound, and an acrylic/copolymer composition, said resultant fabric having combined tensile strength of at least about 800 grams/ounce of fabric, said nonwoven fabric have a Taber Abrasion of at least about 1000 cycles after application of said binder composition.

7. A method of making a nonwoven fabric in accordance with claim 6, wherein:

said step of providing said three-dimensional image transfer device includes providing said image transfer device with an array of three-dimensional surface elements having an octagon-and-square configuration.

8. A method of making a nonwoven fabric in accordance with claim 6, wherein:

said step of providing said three-dimensional image transfer device includes providing said image transfer device with an array of three-dimensional surface elements having a herringbone configuration.

* * * * *